United States Patent [19]

Rejto

[11] 4,138,945

[45] Feb. 13, 1979

[54] SIMULTANEOUS HEAT TRANSFER PRINTING AND EMBOSSING METHOD

[76] Inventor: Thomas Rejto, 19 Homestead Rd., Greenwich, Conn.

[21] Appl. No.: 797,537

[22] Filed: May 16, 1977

Related U.S. Application Data

[63] Continuation of Ser. No. 597,562, Jul. 21, 1975, abandoned.

[51] Int. Cl.[2] ..... B41M 5/26; D06P 7/00

[52] U.S. Cl. ..... 101/470; 8/2.5 A; 101/32; 427/270; 427/272

[58] Field of Search ..... 8/2.5 A; 101/470, 32; 427/270, 272, 277

[56] References Cited

U.S. PATENT DOCUMENTS

| | | | |
|---|---|---|---|
| 1,895,243 | 1/1933 | Dort | 101/470 |
| 2,549,847 | 4/1951 | Oldofredi | 101/32 |
| 2,681,612 | 6/1954 | Reimann | 101/32 |
| 2,783,175 | 2/1957 | Smith et al. | 101/32 |
| 3,848,435 | 11/1974 | Armstrong | 101/470 |
| 3,868,214 | 2/1975 | Shackleton | 101/470 |
| 3,915,628 | 10/1975 | Bossard | 101/470 |

*Primary Examiner*—Clyde I. Coughenour

[57] ABSTRACT

A method for printing and embossing thermoplastic man-made fabrics, non-wovens and other deformable materials wherein in a heat transfer printing process embossing and/or surface texturing means are introduced simultaneously with the printing means and material to be printed.

6 Claims, 6 Drawing Figures

SIMULTANEOUS HEAT TRANSFER PRINTING AND EMBOSSING METHOD

Figure 1:
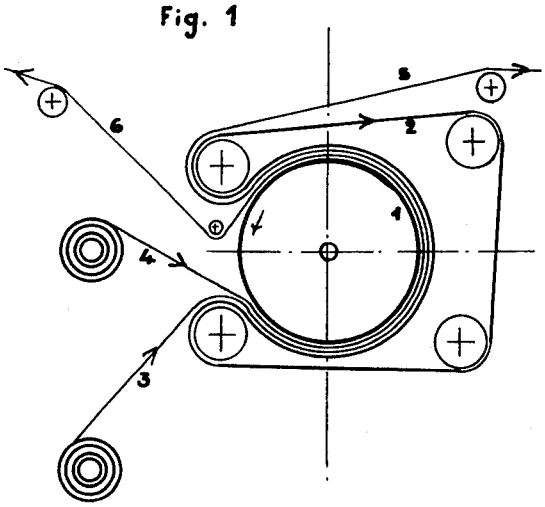

This is a continuation of application Ser. No. 597,562 filed July 21, 1975, now abandoned.

BACKGROUND OF INVENTION

This invention relates generally to a method for heat transfer printing and embossing of man-made fabrics wherein the printing and embossing or surface texturing processes are combined in one simultaneous operation.

In the relatively new printing method called heat transfer printing, the inks are not directly deposited on the fabric or other materials to be decorated but are first printed on a paper or other perfectly flat substance. However, the composition of the ink and/or the preparation of the paper or other surface used is such that when held firmly against the fabric or other materials to be decorated, and then heated, the colors are transferred permanently to these materials. The operation is carried out on a heated transfer calender if a continuous method is used or on a heated press if a static method is applied. The heat required is in the range of 340 to 430 degrees Fahrenheit. Contact time will range generally from 5 to 40 seconds. The transfer paper is held in contact with the material to be printed by pressure means. The pressure to be applied can be as low as 1 lb. per square inch and rarely exceeds 50 lbs. per square inch.

The heat transfer printing method has two major advantages over the conventional printing methods: 1. a better registration of the designs can be obtained because all colors are transferred at the same time from the printed transfer paper, while in conventional printing one color is deposited after the other and a perfect registration is nearly impossible to obtain; and 2. the fabric inventory can be held very low because of the existing possibilities to transform at any time any quantity of white fabric into printed fabric thanks to the less expensive transfer papers held in stock.

On the other hand, the heat transfer printing system has also two major disadvantages: 1. it flattens the material to be printed. This can be explained by the contact under pressure and heat with a perfectly flat printing paper and results usually in a printed material having a "slickly hand", undesirable for many uses. Only fabrics of special composition, involving higher prices, can avoid this inconvenience. Another remedy is the use of after-treatments to improve the hand, but these are costly and result in a considerable loss of time; and 2. losses on inventory transfer paper can be high if, as a result of fashion change or other reasons, orders for a particular design or color combination diminish while important quantities of corresponding paper remains in stock.

SUMMARY OF INVENTION

In view of the foregoing, it is the main object of this invention to provide a method which enhances the advantages and overcomes the drawbacks of prior art methods by combining in a single operation transfer printing and embossing or surface texturing carried out simultaneously on existing transfer printing machines with little or no modification in the machine's set-up.

A significant feature of the method as practised in accordance with this invention is a substantial saving in money from further fabric inventory reduction. In fact, it enables the obtention on a single type of fabric of not only different color and/or design effects but also of different 3-dimensional pattern effects. In the present state of the art, this can be obtained only if the transfer printing is applied on different fabrics, knitted, woven or otherwise manufactured with the different patterns.

Another significant feature of the method is its ability to change favorably the hand of the heat transfer printed fabrics, increasing their acceptability in fields where heat transfer printed materials met with resistance.

Another important feature of the method is that by modifying the aspect of the transferred design, papers otherwise out of style and of no value can be reused.

Briefly stated, the fact that the temperatures, pressures and contact times causing permanent deformation of thermoplastic materials to be printed are about the same as those required for heat transfer printing, makes possible a simultaneous printing and embossing operation by the introduction of surface texturing or embossing means at the same time as the printing paper and the material to be printed. All three will be held together in close contact during the operation. If the operation is executed on a continuous calender, the embossing and/or surface texturing surface should be flat and flexible enough to move through the machine. The embossing surface can be introduced between the printing paper and the fabric, on top of the printing paper or under the fabric. Depending on the relative position of the embossing surface, the design and texture to be imparted to the fabric will vary.

The embossing surface can be of full width or narrower than the fabric if only a partial embossing and/or surface texturing effect is desired.

The transfer printing surface and the embossing surface can also be one single body if the printing surface is made or treated in such a way that it can emboss or surface-texture the material to be printed, or if the surface texturing or embossing surface can at the same time deposit color on the material to be printed.

OUTLINE OF DRAWINGS

Figure 2:
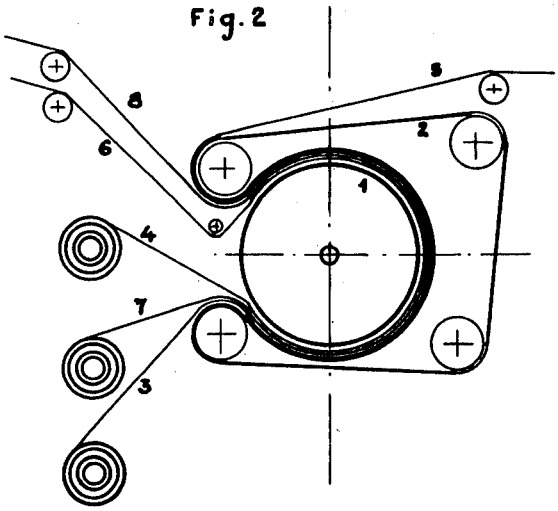
Figure 3:
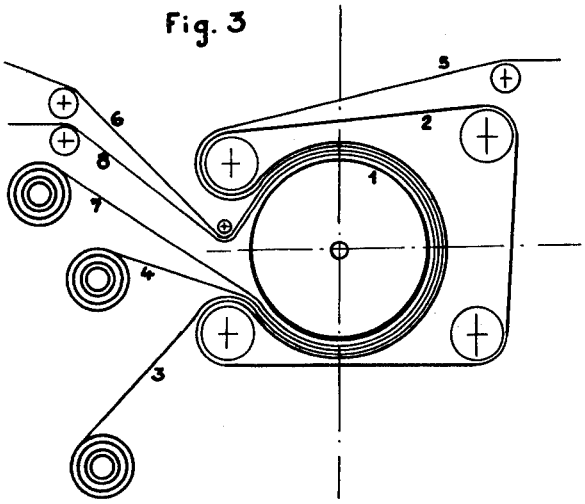
Figure 4:
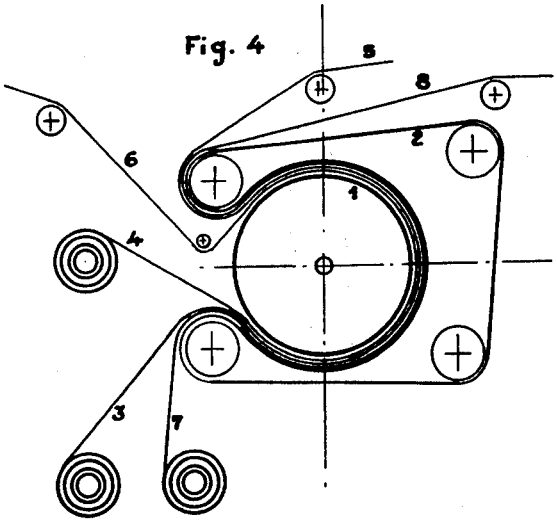

For a better understanding of the invention as well as other objects and further features thereof, reference is made to the following detailed description to be read in conjunction with the accompanying drawing wherein:

FIG. 1 schematically shows a continuous heat transfer printing calender with the fabric and transfer paper being fed into the machine;

FIG. 2 schematically shows an arrangement according to the invention whereby an embossing surface is fed into the machine between the printing paper and fabric;

FIG. 3 schematically shows an arrangement according to the invention whereby an embossing surface is fed into the machine over the printing paper, the latter being sandwiched between the embossing surface and the fabric; and FIG. 4 schematically shows an arrangement according to the invention whereby an embossing surface is fed into the machine under the fabric, the latter being sandwiched between the printing paper and the embossing surface.

Figure 5:
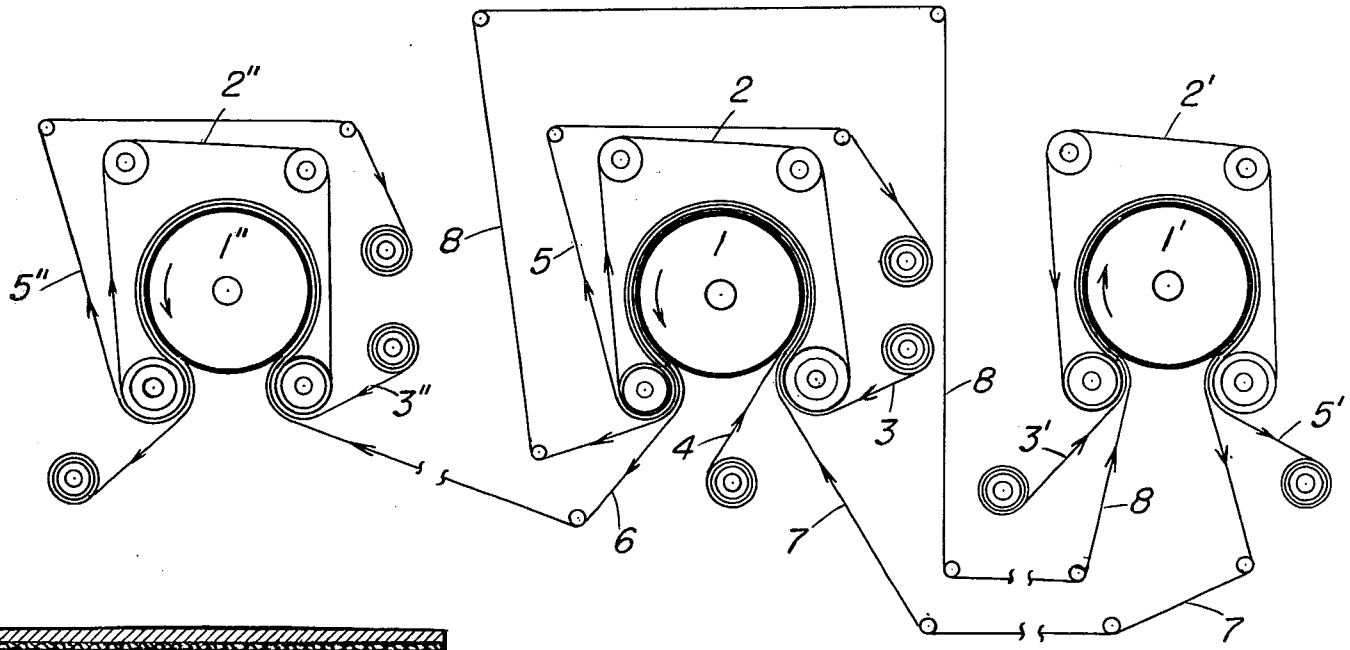

FIG. 5 schematically shows an arrangement according to the invention whereby secondary uses can be made of the embossing and printed paper means.

Figure 6:
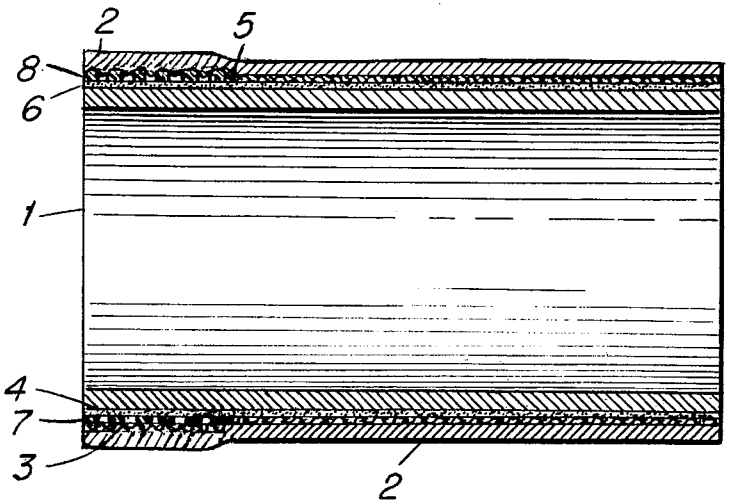

FIG. 6 shows the embossing means extending less than the full width of the fabric.

DESCRIPTION OF THE INVENTION

Referring now to FIG. 1, there is shown a transfer printing calender with heated transfer roller 1, continuous conveyor belt 2, unprinted fabric 3, transfer printing paper 4, printed fabric 5, and exhausted transfer printing paper 6.

The printing is carried out by means of heat transfer from the transfer printing paper 4 to the fabric or other material to be printed 3. Although paper is in common use, other carriers can be used if they have been first printed or otherwise treated with the dyestuffs or pigments in use for the preparation of normal transfer paper.

In this traditional configuration, the transfer roller is heated to a sufficient temperature to heat up the printing paper and the material to be printed to 340–430 degrees F during their passage. Paper and fabric are firmly pressed against the roller by means of a conveyor belt. The temperature of permanent deformation of the material to be printed, usually a thermoplastic material, is about the same as that used in heat transfer printing. It is this fact that permits simultaneous printing and embossing.

FIG. 2 shows the introduction of an embossing sheet 7 between the fabric 3 and the transfer paper 4. The embossing sheet may be a fabric with very loose texture or with openworks and/or holes, such as screen, net, mesh, tulle, cheesecloth, canvas, lace or similar foraminons means. Natural and/or synthetic fibers can be used for this purpose depending on the results desired. The embossing sheet can also be made of metal, heat-resistant plastic, cardboard, paper or other material. It has to be flat and flexible enough to be able to pass through the transfer printing calender and having at its surface a sufficient number of openings or perforations to let through the desired part of the design to be transferred from the printing paper to the printable material.

The different embossing surfaces impart different characteristics to the printed and embossed fabric and affect also the operational system and the cost of operation.

To illustrate FIG. 2, an example can be given where the embossing surface 7 is a full width lace-type fabric manufactured of polyester, nylon or other fabric, printable by means of dispersible dyes, the transfer printing paper 4 was prepared with inks formulated with suitable dispersible dyes, (also called disperse or dispersed dyes) and the material to be printed 3 is a polyester, nylon or other dispersible-dyeable thermoplastic fabric. When as shown in FIG. 2 the printing paper 4, the fabric to be printed 3 and in between the described type of embossing material 7 are introduced in the heat transfer calender, at the exit of same the treated fabric 5 will be printed and embossed in such a way that at its full width, the lace used as embossing surface is reproduced in white "intaglio", while at the location of holes and openings of the lace, the design of the printing paper 4 was transferred onto the fabric. Thus a simultaneous printing and embossing operation was realized.

An additional advantage of the simultaneous method, as described in this example, lies in the fact that the lace at its exit from the machine, 8 is also permanently printed. If this printed lace, the original embossing means, is mounted on a white fabric, it creates exactly the reverse effect of that obtained on the fabric. This method may be advantageously used in coordinated or decorated fashion items. There is no extra cost to carry out this operation, as the embossing lace itself will be used as a fashion item. The use of an inexpensive no-longer fashionable or left-over transfer printing paper is often possible because of the improvement in the effect, obtained by means of the inserted lace.

Instead of using a full width lace, it is possible to run a ribbon-like lace on top of the fabric, for example at the edge, and create a so-called border design. The printed narrow lace can be used as trimming.

Instead of an intaglio-type embossing, it is also possible to create with the same method a different three-dimensional effect if the lace-type or cardboard-type embossing surface has relatively wide full-bodied flat areas and only relatively small perforations or slots to form the design. In this case, the fabric is compressed and maintained flat and white under the full-bodied areas of the embossing surface and swells through the perforations: the only places where it can expand. Only the raised surfaces are colored by the transfer paper and look very much like an embroidery.

If the embossing surface is made of materials which are not printable by dispersed dyestuffs, it is possible to obtain three different prints using only one transfer printing paper. To understand this possibility, it is necessary to explain that if the printing paper is applied against a material having a dispersible-dyeable surface, most of the dye migrates by sublimation into the material to be printed and the printing paper is exhausted at its exit 6. If the printing paper is applied against a material whose surface has no affinity for dispersible dyes, only about 50% of the ink migrates from the printing paper to this other material. Thus, as seen in FIG. 5 for example, later this printing paper 6 and also the other material 8 which does not hold the dyes, can be used to print dispersible-dyeable fabrics 3' and 3". In the given example, the first print 5 is obtained by the colors going through the perforations of the embossing material which in this case is not dispersible-dyeable. The second 5" and third prints 5' are obtained by the re-use of the printing paper and of the embossing material. In this method, which is extremely advantageous to manufacture inexpensive lace or trim limitations, if a lace-type embossing material is used, the second 5" and third prints 5' look like the reverse of the first but the colors are lighter. During the third printing, the embossing surface and the printing means are combined into one, the pre-printed embossing surface creating the embossing as well as the coloration of the printable goods 3'.

As during this printing-embossing operation the dyestuff will be released from the embossing material, it can be re-used for other cycles. An indefinite number of cycles can be made if the embossing or texturing surface is of metal, for example, a wire screen, net or mesh.

The same wire screen-type embossing material can be also used as sole surface-texturing and printing means without being first pre-printed by a printing paper during a first heat transfer operation. It can instead be colored by dipping in a dye bath, by dye droplets sprayed or sprinkled on its surface following more or less elaborate patterns, as well as by direct printing on the wire and other means.

As an example of the effects which can be obtained, it is interesting to mention the case where a fine metal screen which is first passed through a bath of dispersed dyes and, if necessary, is subsequently dried, is conveyed, firmly maintained against a double-knit polyester fabric through the heated transfer calender. Instead of obtaining a flat uni-color fabric, as would be the case if a solid shade transfer printing paper were used, a basket-weave-type design and surface-texture will be obtained which makes the fabric desirable for use in men's wear.

The metal wire screen, mesh or net can evidently be replaced by other metallic or non-metallic supports giving different surface textures or embossings. Since, in the described example, the colors are not imparted to the printable fabric through the embossing means, it is not necessary to use an embossing material having holes or an open texture. Metal has the advantage of being indefinitely re-usable though cleaning may be required. It is also possible to form with the embossing material an endless belt made preferably of metal and deposit on it new dyestuff continuously, after each printing cycle, while the machine is running. In this manner a continuous transfer printing and embossing operation can be realized since the transfer printing medium does not have to be prepared separately in advance as is the case presently.

In another embodiment of the invention, an endless embossing and/or surface texturing belt made of metal or other strong material on which dyestuff or printing ink is continuously deposited, can be introduced in a transfer printing calender under the fabric as schematically shown in FIG. 4. Given the strength of this belt, the presently used conveyor belt 2 can be suppressed. The design being deposited by this embossing surface texturing belt, the transfer printing paper 4 can also be eliminated, unless a printing on both sides of the fabric is desired. It is no longer necessary to heat the printing cylinder 1 since the printing embossing belt will be heated by infra-red tubes or other sources.

Simultaneous printing and embossing can also be executed according to FIG. 4 by using a regular transfer printing calender where transfer printing paper 4 prints on fabric 3 while an embossing sheet 7 is fed into the machine under the fabric to improve the hand of the fabric. In this case, since no dye has to get through the embossing means, this latter need not have openings or perforations at its surface. This is also the case when the printing embossing is executed as shown in FIG. 3 where the embossing sheet is fed into the machine over the printing paper 4. However, when this method is used, the embossing sheet has to let through the heat coming from roller 1, so if it is not made from loose or perforated material, it has to be a good heat conductor.

Among other possibilities obtainable, I wish to mention the use of partially melting materials as embossing means used inbetween the printing paper 4 and the material to be printed 3, as shown in FIG. 2. Strong three-dimensional effects can be obtained if the material which melts fuses with the goods to be printed under the effect of heat and pressure. It is also worthwhile to mention that some porous materials, such as fiberglass can let through the major portion of sublimating dyestuffs. So, if the embossing means, used in between the printing paper and the fabric to be printed is made of such material, it is possible to obtain an embossing or surface texturing effect practically without any change in the printed design.

While preferred embodiments of a simultaneous printing and embossing method have been shown and described in accordance with the invention, it will be appreciated that many changes and modifications may be made therein without, however, departing from the essential spirit thereof.

I claim:

1. A method of continuously and simultaneously printing and surface texturing a thermoplastic fabric which comprises the steps of simultaneously (a) passing the fabric over a roller while the fabric is in superposed relation with
  (i) a foraminous texturing sheet having foramina therein and having at least one face thereof of surface texture to be imparted to the fabric and with
  (ii) a heat transfer printing sheet bearing a sublimable dye with the texturing sheet between the fabric and with the said face of the texturing sheet adjacent the fabric,
(b) holding the superposed fabric and the texturing and printing sheets against the roller, and
(c) maintaining the roller at a temperature sufficiently high to raise the temperature of the superposed fabric and printing sheet held thereagainst to a value between 340° and 430° F., transferring at least part of the dye by sublimation through the foramina of the texturing sheet to the fabric and texturing the fabric with the texturing sheet; and, subsequently, carrying out simultaneously the further steps of
(d) passing the texturing sheet over a second roller while the texturing sheet is in superposed relation with a second thermoplastic fabric,
(e) holding the superposed texturing sheet and second fabric against said second roller, and
(f) maintaining said second roller at a temperature sufficiently high to raise the temperature of the superposed texturing sheet and second fabric held thereagainst to a value between 340° and 430° F., transferring at least part of the dye transferred from the printing sheet to the texturing sheet to the second fabric and texturing the second fabric.

2. A method of continuously and simultaneously printing and surface texturing a thermoplastic fabric which comprises the steps of simultaneously (a) passing the fabric over a roller while the fabric is in superposed relation with
  (i) a foraminous texturing sheet having foramina therein and having in at least one face thereof a surface texture to be imparted to the fabric and with
  (ii) a heat transfer printing sheet bearing a sublimable dye, with the texturing sheet between the fabric and the printing sheet and with the said face of the texturing sheet adjacent the fabric,
(b) holding the superposed fabric and the texturing and printing sheets against the roller, and
(c) maintaining the roller at a temperature sufficiently high to raise the temperature of the superposed fabric and printing sheet held thereagainst to a value between 340° and 430° F., transferring at least part of the dye by sublimation through the foramina of the texturing sheet to the fabric and texturing the fabric with the texturing sheet; and, subsequently, carrying out simultaneously the further steps of (d) passing the printing sheet over a second roller while the printing sheet is in superposed relation with a second fabric,
(e) holding the superposed printing sheet and second fabric against said second roller, and
(f) maintaining said second roller at a temperature sufficiently high to raise the temperature of the superposed printing sheet and second fabric held thereagainst to a value between 340° and 430° F., transferring at least a part of said adhering dye to the second fabric.

3. A method according to claim 1 which further comprises performing and following steps simultaneously with said steps (d), (e) and (f);

(g) passing, in superposed position with a third thermoplastic fabric, over a third roller, the printing sheet which, shielded by the texturing sheet with little affinity for said sublimable dye, retained an important part of said dye, with the exception of portions which faced the foramina, during step (c) recited in claim 1, (h) holding the superposed printing sheet and third fabric against said third roller, and (i) maintaining said third roller at a temperature sufficiently high to raise the temperature of the superposed printing sheet and third fabric held thereagainst to a value between 340° F and 430° F., transferring at least a part of said adhering dye to the third fabric.

4. A method according to claim 1, which comprises using a texturing sheet of closed loop shape.

5. A method according to claim 3, which comprises using a texturing sheet of closed loop shape.

6. A method of simultaneously printing and partially surface texturing a thermoplastic fabric which comprises the steps of simultaneously (a) placing the fabric in a transfer printing apparatus while the fabric is in superposed relation with (i) a foraminous texturing sheet having foramina therein and having in at least one face thereof a surface texture to be imparted to the fabric and with (ii) a heat transfer printing sheet bearing a sublimable dye, with the texturing sheet between the fabric and the printing sheet and with the said face of the texturing sheet adjacent the fabric, with both said fabric and said printing sheet extending in overlapping relation beyond the limits of said texturing sheet, (b) maintaining the superposed fabric and the texturing and printing sheets for 5 to 40 seconds in the transfer printing apparatus which is heated to a temperature sufficiently high to raise the temperature of the superposed fabric and printing sheet held thereagainst to a value between 340° and 430° F., transferring the dye by sublimation to the fabric from the printing sheet extending beyond said texturing sheet; and transferring at least part of the dye by sublimation through the foramina of the texturing sheet, and partially texturing the fabric with the texturing sheet.

* * * * *